US007307506B2

(12) United States Patent
Yu

(10) Patent No.: US 7,307,506 B2
(45) Date of Patent: Dec. 11, 2007

(54) SAFETY SWITCHES

(76) Inventor: Tsung Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 364 days.

(21) Appl. No.: 11/187,502

(22) Filed: Jul. 22, 2005

(65) Prior Publication Data

US 2007/0018773 A1 Jan. 25, 2007

(51) Int. Cl.
*H01H 37/70* (2006.01)
*H01H 37/52* (2006.01)
*H01H 37/18* (2006.01)

(52) U.S. Cl. ..... 337/94; 337/56; 337/72; 337/66

(58) Field of Classification Search ..... 337/56, 337/72, 66, 94; 200/339, 341
See application file for complete search history.

(56) References Cited

U.S. PATENT DOCUMENTS 3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,223,813 A * 6/1993 Cambreleng et al. ..... 337/66
5,262,748 A * 11/1993 Tsung-Mou ..... 337/66
5,264,817 A * 11/1993 Sorenson ..... 337/68
5,491,460 A * 2/1996 Krasser et al. ..... 337/70
5,539,371 A * 7/1996 Yu ..... 337/66
5,760,672 A * 6/1998 Wang ..... 337/79
5,892,426 A * 4/1999 Huang ..... 337/59
6,275,134 B1 * 8/2001 Chen ..... 337/37
6,307,460 B1 * 10/2001 Yu ..... 337/37
6,400,250 B1 * 6/2002 Wang ..... 337/66
6,445,273 B1 * 9/2002 Yu ..... 337/37
6,456,185 B1 * 9/2002 Yu ..... 337/37
6,512,441 B1 * 1/2003 Yu ..... 337/37
6,525,639 B1 * 2/2003 Cheng ..... 337/37
6,552,644 B2 * 4/2003 Yu ..... 337/66
6,563,414 B2 * 5/2003 Yu ..... 337/66
6,577,221 B1 * 6/2003 Wang ..... 337/59
6,617,952 B1 * 9/2003 Yu ..... 337/94
6,621,402 B2 * 9/2003 Huang ..... 337/66
6,664,884 B1 * 12/2003 Yu ..... 337/59

(Continued)

FOREIGN PATENT DOCUMENTS

FR 2605142 A1 * 4/1988

*Primary Examiner*—Anatoly Vortman

(57) ABSTRACT

A switch includes a switch member and an extension and a push rod respectively extended from two ends of an underside of the switch member. A bi-metallic contact plate has a first end fixed to one of two terminals and a contact portion splits from the contact plate. A first contact point is connected to an underside of the contact portion and a second contact point is connected to the other terminal. A free end of the contact portion is connected with a free first end of a spring member and a second end of the spring member is connected to the contact plate. When overload, the contact portion and the spring member move upward to cut off the circuit while the push rod extends through a through hole defined in the spring member.

7 Claims, 6 Drawing Sheets

U.S. PATENT DOCUMENTS 6,674,033 B1 * 1/2004 Wang ..... 200/334
6,714,116 B1 * 3/2004 Sang et al. ..... 337/68
6,734,779 B2 * 5/2004 Yu ..... 337/59
6,788,186 B1 * 9/2004 Yu ..... 337/66
6,864,453 B1 * 3/2005 Yu ..... 200/520
6,940,389 B1 * 9/2005 Yu ..... 337/66
7,030,726 B2 * 4/2006 Yu ..... 337/66
2003/0160679 A1 * 8/2003 Yu ..... 337/37
2005/0140489 A1 * 6/2005 Kuo ..... 337/66

* cited by examiner

SAFETY SWITCHES

BACKGROUND OF THE INVENTION

1. Field of the Invention

The present invention relates to a safety switch that ensures the bi-metallic plate to be deformed as desired when overloaded.

2. The Prior Arts

A conventional switch device, especially for those switches using bi-metallic plate to prevent from being burn when an overload happens, generally includes a bi-metallic plate which is deformed when overloaded so as to separate the two contact points respectively located on the bimetallic plate and one of the two terminals. Some inherent shortcomings for these conventional safety switches are experienced. There are too many parts involved in the safety switches and a longer period of time is required when assembling the switches, so this increases the cost of the products. The parts might be arranged inaccurately and affect the deformation of the bi-metallic plate. Once the bimetallic plate is deformed to cut off the circuit, because of the improper arrangement of the parts as mentioned above, the bi-metallic plate could deform to re-connect the two contact points to connect the circuit again. Because of the inaccuracy of the deformation of the bi-metallic plate, the switch member cannot be set at "OFF" position after the bimetallic plate is deformed to cut off the circuit.

Therefore, it is desired to have a safety switch that allows the bi-metallic plate to deform toward a desired direction and has enough space for the deformation of the bi-metallic plate to prevent the bimetallic plate from bouncing back to connect the circuit again.

SUMMARY OF THE INVENTION

In accordance with an aspect of the present invention, there is provided a switch that comprises a body with a top opening and a switch member pivotably engaged with the top opening of the body. An extension extends from a first end of an underside of the switch member and a push rod extends from a second end of the underside of the switch member. A protrusion extends axially from a distal end of the push rod. A first terminal and a second terminal extend through a bottom of the body.

A contact plate has a first end fixed to the first terminal and a second end of the contact plate is a free end. A contact portion splits from the contact plate and a first contact point is connected to an underside of the contact portion. A free end of the contact portion is located above a top surface of the contact plate and connected with a free first end of a spring member. A second end of the spring member is connected to the contact plate. A through hole is defined through the spring member. A second contact point is connected to the second terminal and located beneath the first contact point on the contact portion. The second end of the contact plate and the free end of the contact portion are deformed in opposite directions when being heated. The extension of the switch member is located above the second end of the contact plate and presses the second end of the contact plate downward when the switch member is at "OFF" position. When the second end of the switch member is pushed downward to "ON" position, the spring member is pushed by the push rod to lower the first contact point to be in contact with the second contact point, and the protrusion slips into the through hole. A space is defined between the push rod and an inner periphery of the through hole. When overloaded, the contact portion is deformed upward to move the spring member upward and the push rod extends through the through hole to allow the upward movement of the spring member to be completed.

The main object of the present invention is to provide a safety switch that provides a push rod extending from the underside of the switch member and the spring member connected with the contact portion includes a through hole which allows the push rod to extend therethrough so as not to stop the upward movement of the spring member when overloaded.

Another object of the present invention is to provide a safety switch wherein the two ends of the switch member are in contact with the two ends of the contact plate such that the contact plate is moved precisely.

Yet another object of the present invention is to provide a safety switch that includes less number of parts so as to have lower manufacturing cost.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
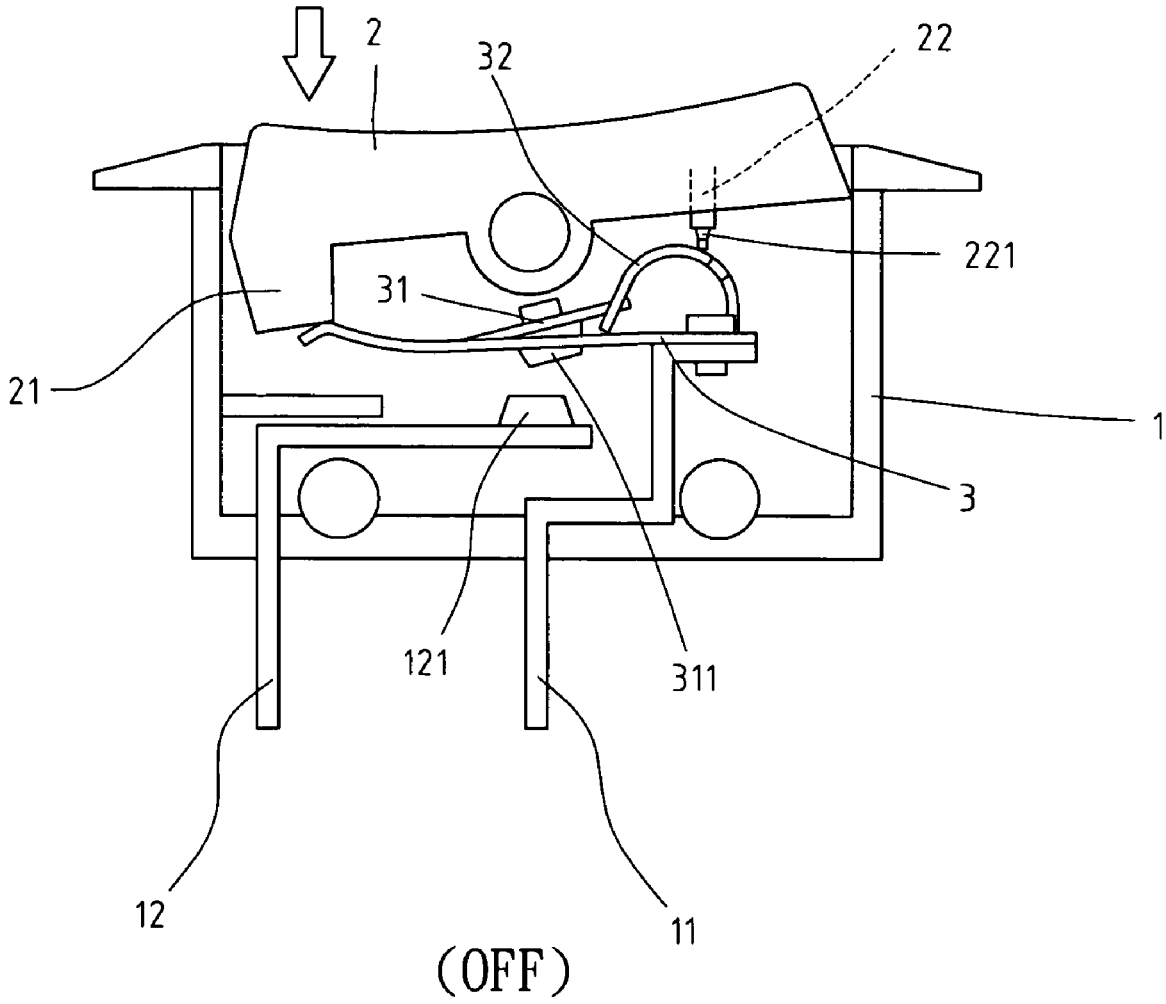
FIG. 1 is a sectional view showing an "OFF" status of a safety switch in accordance with the present invention.
Figure 2:
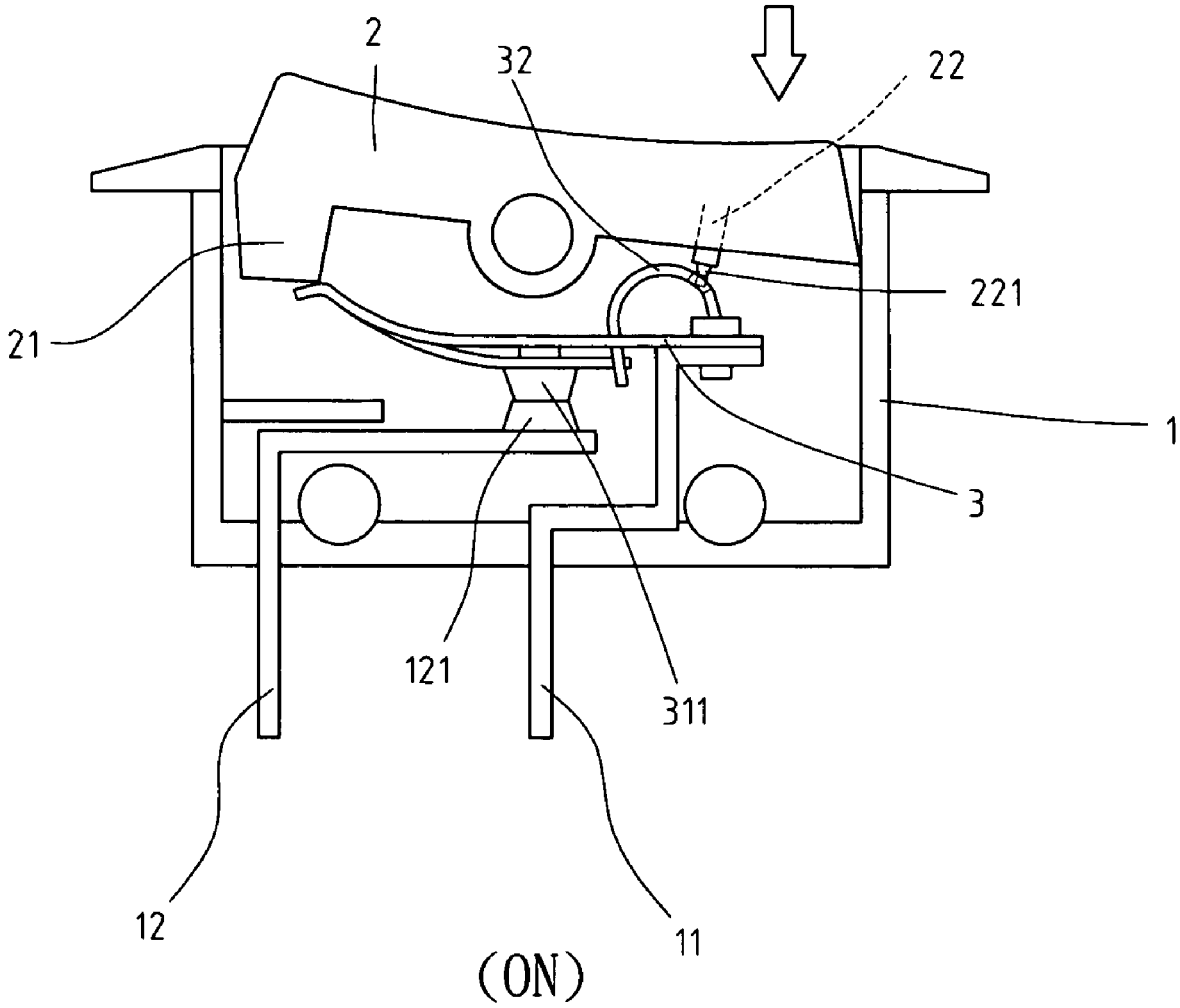
FIG. 2 is a sectional view showing an "ON" status of the safety switch in accordance with the present invention.
Figure 6:
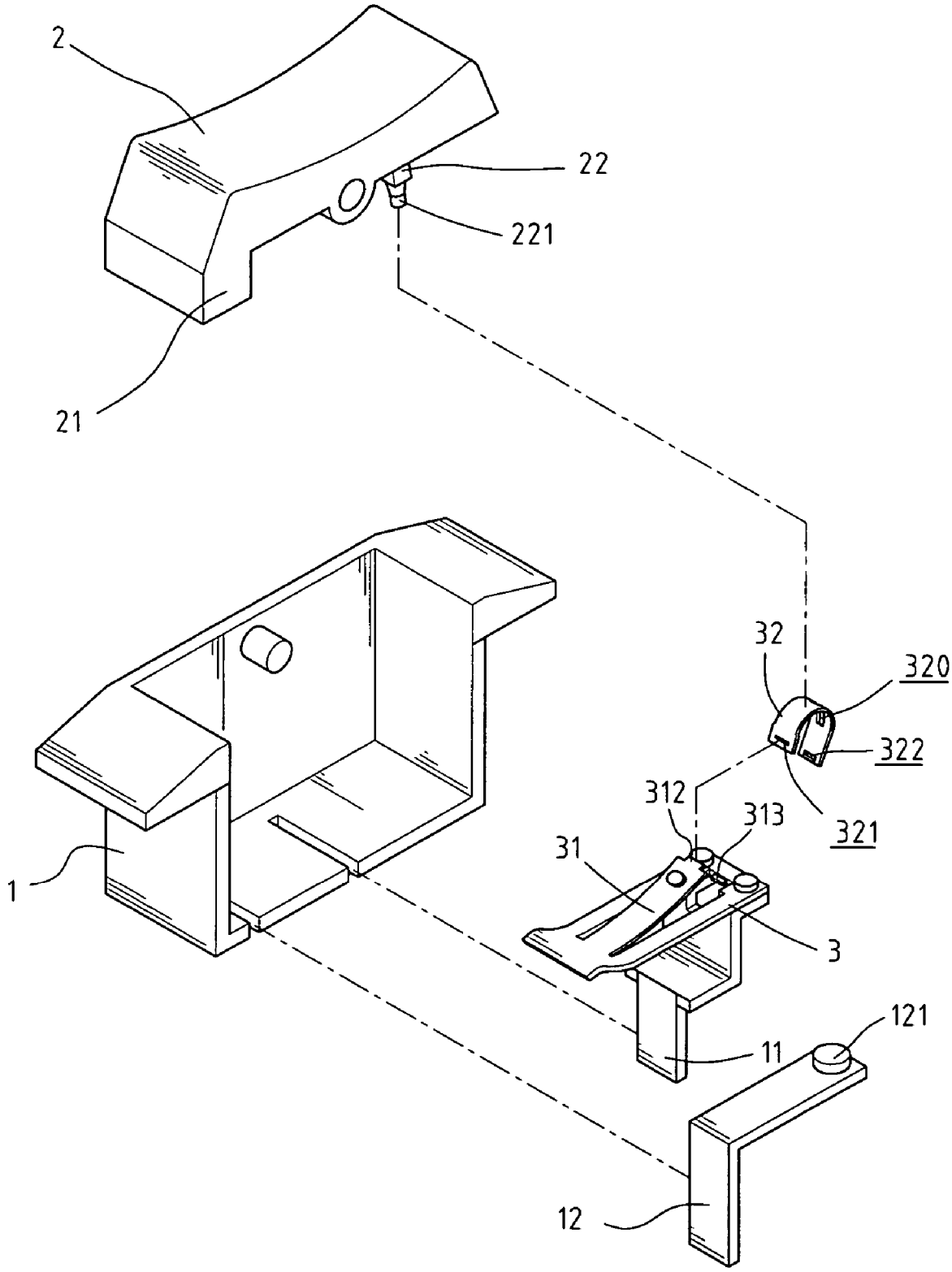
FIG. 6 is an exploded view of the safety switch in accordance with the present invention.

Referring to the drawings and in particular to FIGS. 1, 2 and 6, a safety switch in accordance with the present invention comprises a body 1 with a top opening and a switch member 2 is pivotably engaged with the top opening of the body 1 such that the switch member 2 is pivoted about a pin at a middle portion thereof. An extension 21 extends from a first end of an underside of the switch member 2 and a push rod 22 extends from a second end of the underside of the switch member 2. A protrusion 221 extends axially from a distal end of the push rod 22. The protrusion 221 is a cylindrical and tapered protrusion and a distal end of the protrusion is rounded. The diameter of the protrusion 221 is smaller than that of the push rod 22. A first terminal 11 and a second terminal 12 extend through a bottom of the body 1.

A contact plate 3, which is a curved flexible bi-metallic plate, has a first end fixed to the first terminal 11 and a second end of the contact plate 3 is a free end. A contact portion 31 splits from the contact plate 3 and a first contact point 311 is connected to an underside of the contact portion 31. A free end of the contact portion 31 is located above a top surface of the contact plate 3 and connected with a free first end of a U-shaped spring member 32. The free end of the contact portion 31 has a tongue 312 and the free first end of the spring member 32 has a first slot 321 with which the tongue 312 is engaged. A second end of the spring member 32 has a second slot 322 and a ridge 313 extends from an inner periphery of an opening from which the contact portion 31 splits. The ridge 313 is engaged with the second slot 322. A through hole 320 is defined through the spring member 32 and located close to the second end of the spring member 32. A second contact point 121 is connected to the second terminal 12 and located beneath the first contact point 311 on the contact portion 31. The second end of the contact plate 3 and the free end of the contact portion 31 are deformed in opposite directions when the contact plate 3 is heated.

Figure 3:
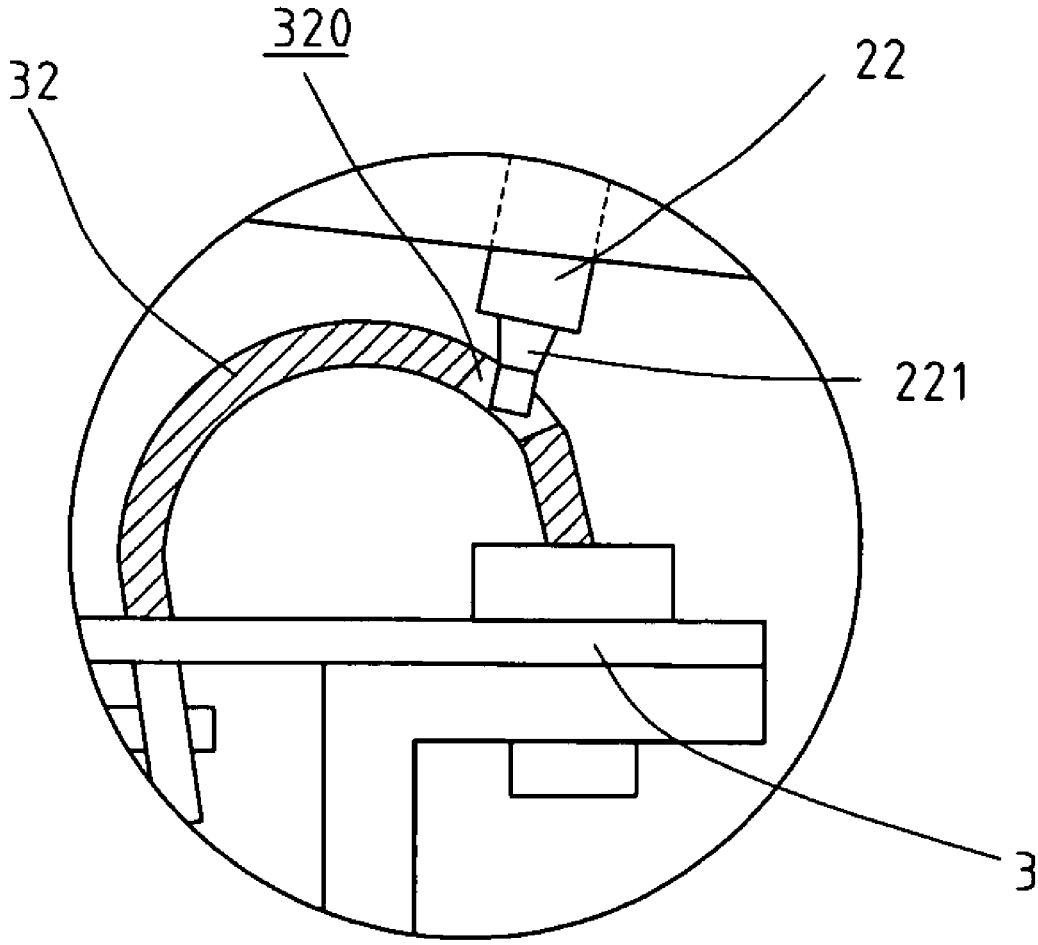
FIG. 3 shows that a protrusion of a push rod is inserted into a through hole in a spring member when at "ON" status.

The extension 21 of the switch member 2 is located above the second end of the contact plate 3 so that when pushing the switch member 2 at the first end thereof, the second end of the contact plate 3 is pushed downward by the extension 21 and the contact portion 31 is bent upward so that the two contact points 311, 121 are separated to set the switch to be at "OFF" position. When the second end of the switch member 2 is pushed downward to "ON" position, the spring member 32 is pushed by the push rod 22 to lower the first contact point 311 to be in contact with the second contact point 121 and the protrusion 221 slips into the through hole 320 as shown in FIG. 3. It is noted that an inner diameter of the through hole 320 of the spring member 32 is larger than an outer diameter of the push rod 22, so that a space is defined between the push rod 22 and the inner periphery of the through hole 320.

Figure 4:
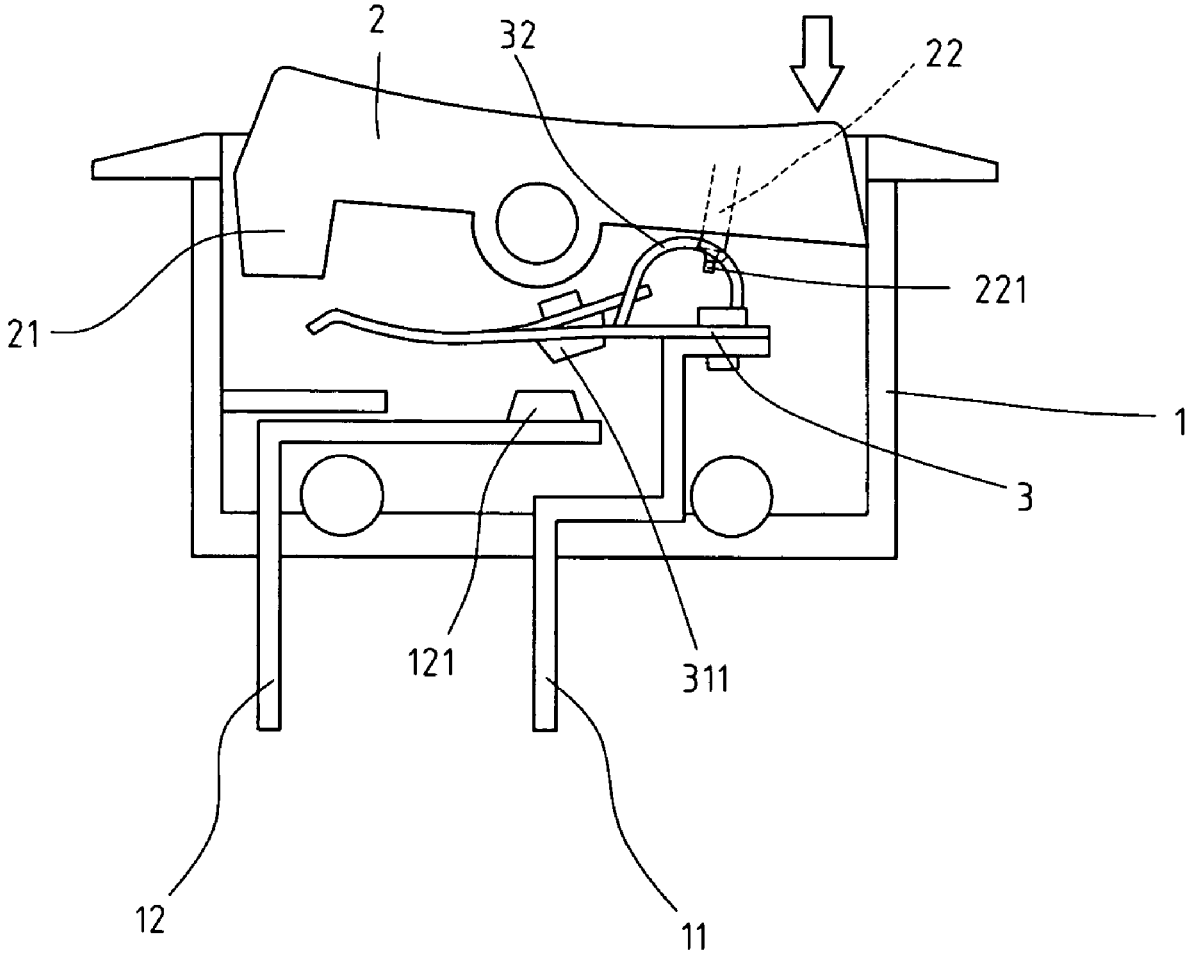
FIG. 4 shows that a second end of a contact plate is deformed downward and a contact portion is deformed upward to separate two contact points when overloaded.
Figure 5:
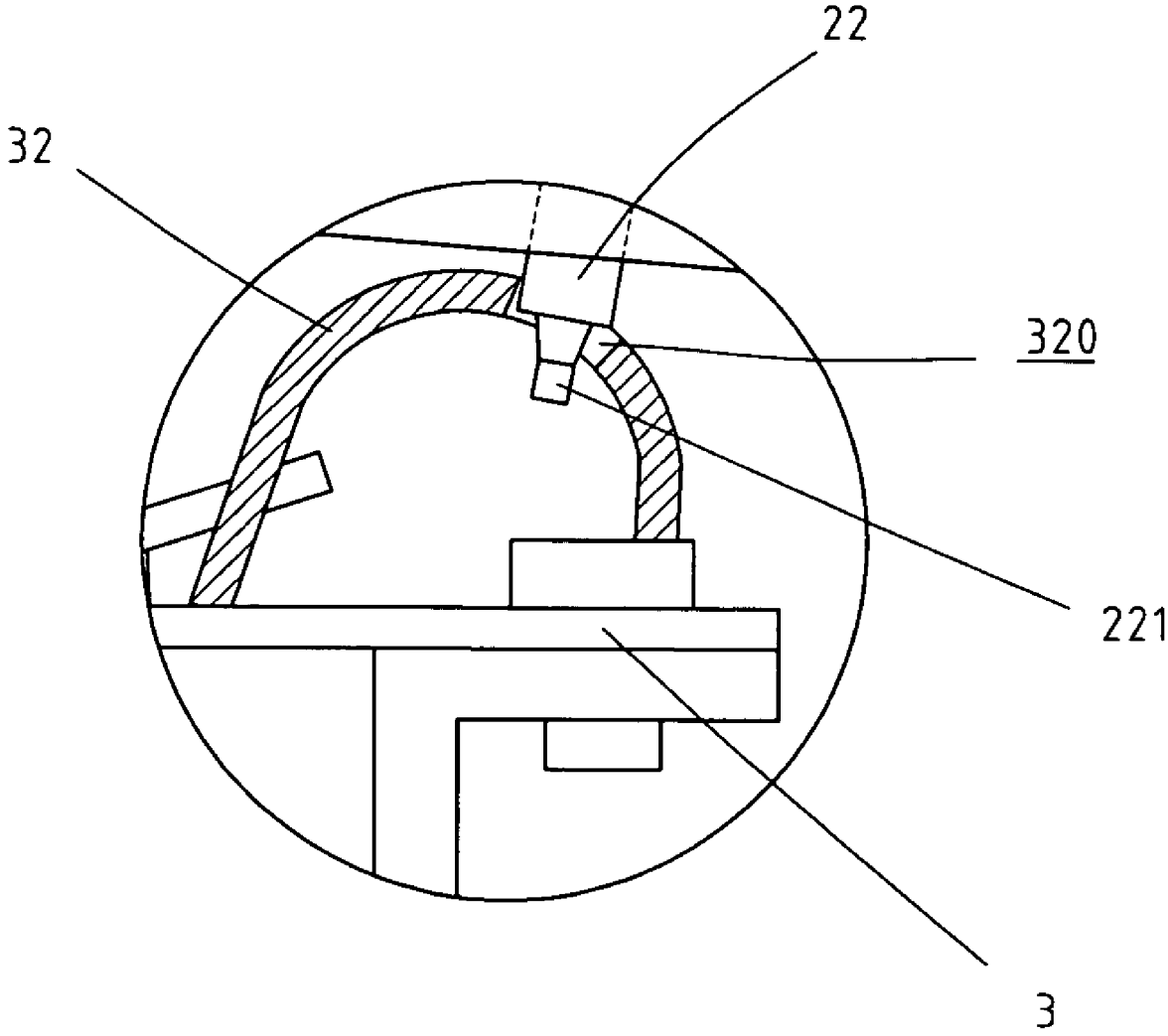
FIG. 5 shows that duringd the overload, the push rod extends through the through hole in the spring member.

Referring to FIGS. 4 and 5, when overloaded at "ON" position, the contact portion 31 is deformed upward to separate the two contact points 311, 121, and the spring member 32 moves upward together with the free end of the contact portion 31. The push rod 22 extends through the through hole 320 to allow the upward movement of the spring member 32 to be completed. The user may push the first end of the switch member 2 to set the switch member 2 at "OFF" position.

While we have shown and described the embodiment in accordance with the present invention, it should be clear to those skilled in the art that further embodiments may be made without departing from the scope of the present invention.

What is claimed is:

1. A switch, comprising a body with a top opening and a switch member pivotably engaged with the top opening of the body, an extension extending from a first end of an underside of the switch member and a push rod extending from a second end of the underside of the switch member, a protrusion extending axially from a distal end of the push rod, a first terminal and a second terminal extending through a bottom of the body; and a contact plate being a curved flexible metal plate and having a first end fixed to the first terminal and a second end of the contact plate being a free end, a contact portion splitting from the contact plate and a first contact point connected to an underside of the contact portion, a free end of the contact portion located above a top surface of the contact plate and connected with a free first end of a spring member, a second end of the spring member connected to the contact plate, a through hole defined through the spring member, a second contact point connected to the second terminal and located beneath the first contact point on the contact portion, the second end of the contact plate and the free end of the contact portion being deformed in opposite directions when being heated, the extension of the switch member located above the second end of the contact plate and pressing the second end of the contact plate downward when the switch member is at "OFF" position, when the second end of the switch member is pushed downward to "ON" position, the spring member being pushed by the push rod to lower the first contact point to be in contact with the second contact point and the protrusion slipping into the through hole, a space defined between the push rod and an inner periphery of the through hole, when overloaded, the contact portion being deformed upward to move the spring member upward and the push rod extending through the through hole to allow the upward movement of the spring member to be completed.

2. The switch as claimed in claim 1, wherein the free end of the contact portion has a tongue and the free first end of the spring member has a first slot with which the tongue is engaged.

3. The switch as claimed in claim 1, wherein the second end of the spring member has a second slot and a ridge extends from an inner periphery of an opening from which the contact portion splits, and the ridge is engaged with the second slot.

4. The switch as claimed in claim 1, wherein the spring member is a U-shaped member.

5. The switch as claimed in claim 1, wherein the contact plate is a bi-metallic plate.

6. The switch as claimed in claim 1, wherein an inner diameter of the through hole in the spring member is larger than an outer diameter of the push rod.

7. The switch as claimed in claim 1, wherein the protrusion is a cylindrical and tapered protrusion, a distal end of the protrusion is rounded.

* * * * *